US007330201B2

(12) United States Patent
Mindler et al.

(10) Patent No.: US 7,330,201 B2
(45) Date of Patent: Feb. 12, 2008

(54) THERMAL PRINTER AND METHOD FOR OPERATING SAME

(75) Inventors: Robert F. Mindler, Churchville, NY (US); Robert C. Cohoon, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 184 days.

(21) Appl. No.: 11/236,946

(22) Filed: Sep. 28, 2005

(65) Prior Publication Data

US 2007/0070168 A1 Mar. 29, 2007

(51) Int. Cl.
*B41J 2/36* (2006.01)

(52) U.S. Cl. ..... 347/194; 347/189; 400/120.14

(58) Field of Classification Search ..... 347/171, 347/188–189, 194; 400/120.14, 120.09
See application file for complete search history.

(56) References Cited

U.S. PATENT DOCUMENTS 4,496,824 A 1/1985 Kawai et al.
4,540,295 A * 9/1985 Okunishi et al. ..... 400/124.03
4,778,293 A * 10/1988 Teshima et al. ..... 400/124.03
4,797,837 A 1/1989 Brooks
5,059,044 A * 10/1991 Takaishi ..... 400/120.14
5,800,082 A * 9/1998 Yamasawa ..... 400/120.14

FOREIGN PATENT DOCUMENTS

EP 0 346 833 A2 12/1989
EP 0 482 850 A2 10/1991
EP 0 795 405 A2 9/1997

* cited by examiner

*Primary Examiner*—Huan Tran

(57) ABSTRACT

A printer that applies donor material from donor patches on a donor web to a receiver medium using a thermal printhead that generates heat and a method for operating such a printer are provided. The method comprises the steps of: receiving a print order requesting the printing of a quantity of images; determining a temperature of the printhead; printing a designated number of the quantity of the images in a sequence; determining a length of time of a programmed delay; delaying the printing for the determined length of time of the programmed delay; and printing remaining images from the quantity of images. The length of each programmed delay is determined by using the temperature of the printhead and a time rate of cooling of the printhead and, is determined in a manner that provides a sufficient cooling time to prevent the printhead from reaching a maximum printhead temperature during printing.

20 Claims, 4 Drawing Sheets

THERMAL PRINTER AND METHOD FOR OPERATING SAME

FIELD OF THE INVENTION

The present invention relates to thermal printers of type that apply material from a donor web to a receiver web in order to form images on the receiver web.

BACKGROUND OF THE INVENTION

In thermal printing, it is generally well known to render images by heating and pressing one or more donor materials such as a dye, colorant or other coating against a receiver medium. The donor materials are provided in sized donor patches on a movable web known as a donor ribbon. The donor patches are organized on the ribbon into donor sets, each set containing all of the donor patches that are to be used to record an image on the receiver medium. For full color images, multiple color dye patches can be used, such as yellow, magenta and cyan donor dye patches. Arrangements of other color patches can be used in like fashion within a donor set. Additionally, each donor set can include an overcoat or sealant layer.

Thermal printers offer a wide range of advantages in photographic printing including the provision of truly continuous tone scale variation and the ability to deposit, as a part of the printing process a protective overcoat layer to protect the images formed thereby from mechanical and environmental damage. Accordingly, the most popular photographic kiosks and home photo printers currently use thermal printing technology.

There is, however, a desire to have such printers print images at a faster rate. This requires that such thermal printers transfer donor material at a higher rate of speed, which in turn, allows a reduced time period for donor material transfer—per picture image element (pixel). Accordingly, the thermal load that must be applied to cause donor material to be transferred to the receiver medium must be delivered in this reduced time period. This requires an increase in the temperatures that are delivered to the donor ribbon. These increased temperatures can negatively impact the printing process.

What is needed therefore is a control system for use with a thermal printer that allows a high rate of printing while preventing overheating of the printhead particularly during extended printing jobs.

What is also needed is a control system that can control such temperatures without requiring extended print delays between individual images within the printing order as consumers and even some retailers can confuse such delays with an end of the process of printing the print order and thus can erroneously package and deliver only those images that were printed before the extended print delay.

SUMMARY OF THE INVENTION

In one aspect of the invention, a thermal printer is provided. The thermal printer comprises a donor transport system having a motorized system for advancing a donor web relative to a printhead, the donor web having patches of donor material including at least one colored donor material; a receiver transport system having a motorized system for advancing a receiver web relative to the printhead; the printhead being able to actuate heat and transfer donor material from the donor web to the receiver web; a first thermal sensor adapted to sense thermal energy indicative of the temperature of the printhead and to generate a primary thermal feedback signal representative of the temperature of the printhead; a controller for controlling the operation of the donor transport system, the receiver transport system, and the printhead so as to enable imagewise transfer of donor material onto the receiver web to form a sequence of at least two images, the controller being operable to interpose at least one programmed delay between the printing of at least two of the images in the sequence; wherein the controller determines the length of each programmed delay by using the temperature of the thermal printhead and a time rate of cooling of the printhead in a manner that is adapted to provide a sufficient cooling time to prevent the printhead from reaching a maximum printhead temperature during printing of the sequence of images.

In another aspect of the invention, a method is provided for operating a printing system which applies donor material from donor patches on a donor web to a receiver medium using a thermal printhead that generates heat. In this aspect, the method comprises the steps of: receiving a print order requesting the printing of a quantity of images; determining a temperature of the printhead printing a designated number of the quantity of the images in a sequence; determining a length of time of a programmed delay; delaying the printing for the determined length of time of the programmed delay; and printing remaining images from the quantity of images; wherein the length of each programmed delay is determined by using the temperature of the thermal printhead and a time rate of cooling of the printhead and is determined in a manner that provides a sufficient cooling time to prevent the printhead from reaching a maximum printhead temperature during printing of the sequence of images.

In still another aspect of the invention, a method is provided for operating a printing system which applies donor material from donor patches on a donor web to a receiver medium using a thermal printhead that generates heat. In this aspect, the method comprises the steps of: receiving a print order requesting the printing of a quantity of images; determining a temperature of the printhead organizing the quantity of images requested in the print order into sequences of a determined number of images; and printing the sequences of images with a programmed delay between each sequence; wherein the length of each programmed delay is determined based upon the temperature of the thermal printhead and a time rate of cooling of the printhead and is calibrated in a manner that provides provide a sufficient cooling time to prevent the printhead from reaching a maximum printhead temperature during the printing of a subsequent one of the sequences.

DETAILED DESCRIPTION OF THE INVENTION

Figure 1:
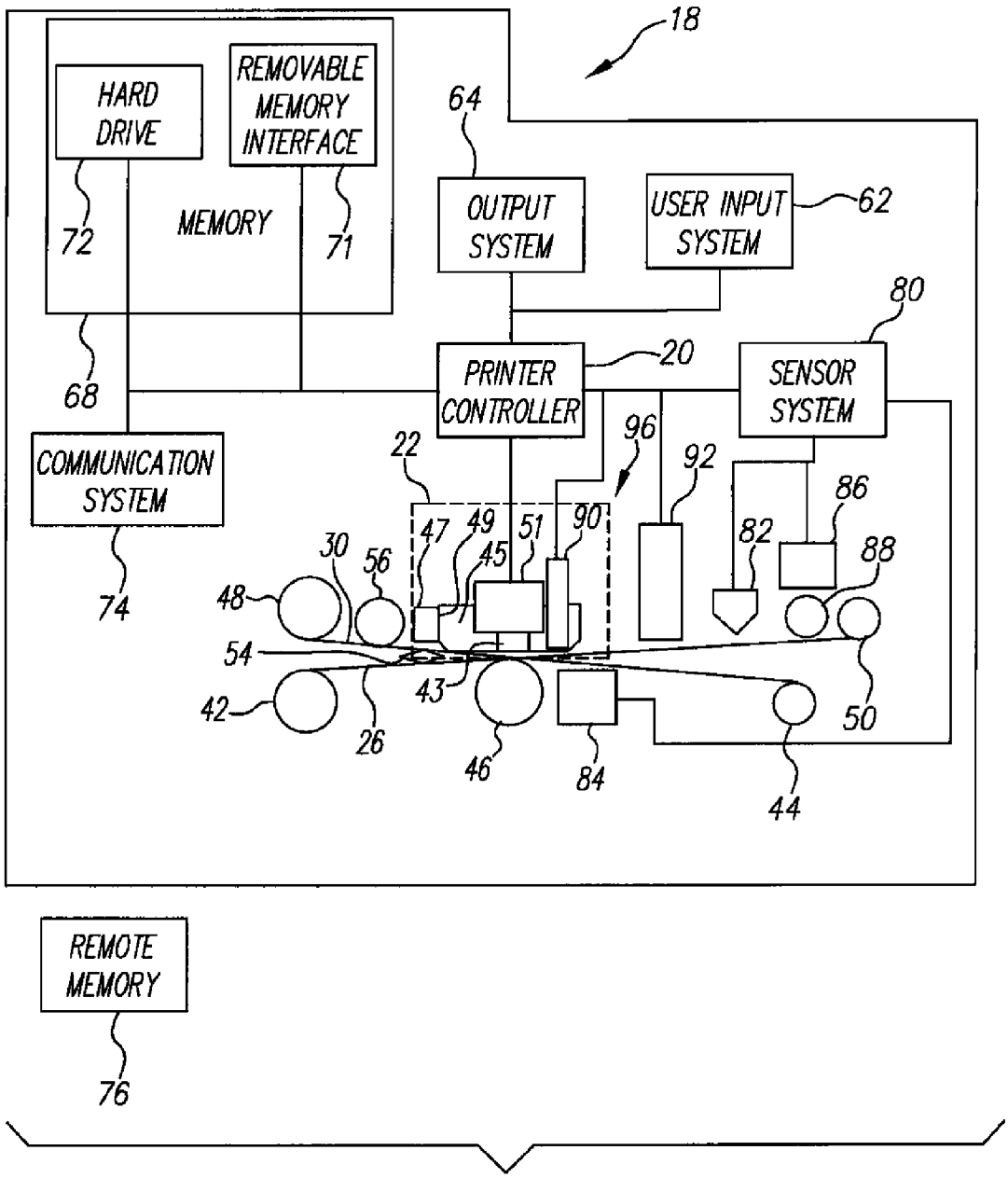
FIG. 1 shows a printer having one embodiment of the control system of the invention.

FIG. 1 shows one embodiment a printer 18 of the invention. As shown in FIG. 1, printer 18 has a controller 20 that causes printhead 22 to record images on a receiver medium 26 by applying heat and pressure to transfer material from a donor web 30 to receiver medium 26. Controller 20 can include but is not limited to a programmable digital computer, a programmable microprocessor, a programmable logic controller, a series of electronic circuits, a series of electronic circuits reduced to the form of an integrated circuit, or a series of discrete components. In the embodiment of FIG. 1, controller 20 also controls a receiver medium take-up roller 42, a receiver medium supply roller 44, a donor web take-up roller 48 and a donor web supply roller 50, which are each motorized for rotation on command of the controller 20 to effect movement of receiver medium 26 and donor web 30.

Figure 2:
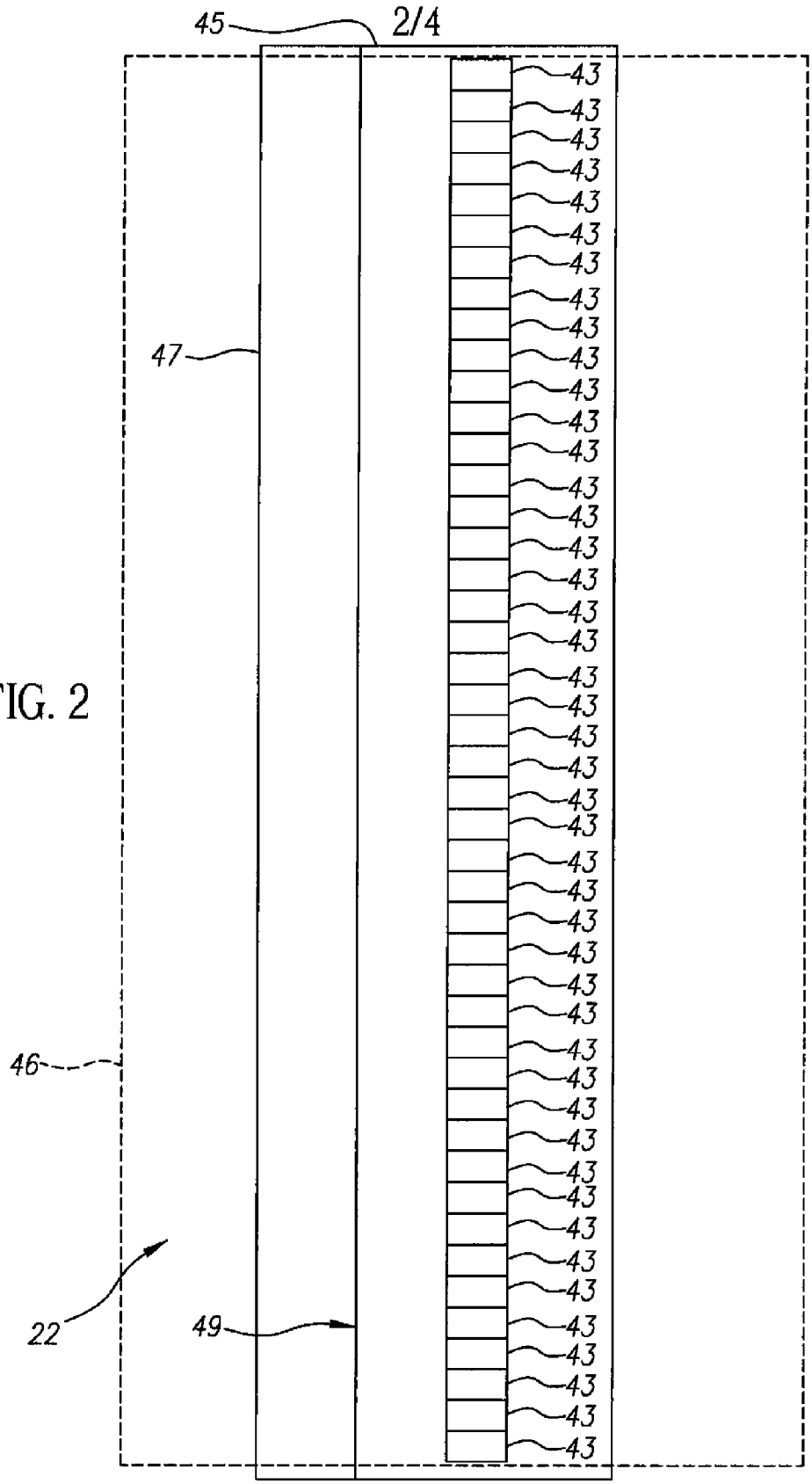
FIG. 2 shows a bottom view of one embodiment of a thermal printhead used in the printer of FIG. 1.

FIG. 2 shows a bottom view of a illustration of one embodiment of a conventional thermal printhead 22 with an array of thermal resistors 43 fabricated in a ceramic substrate 45. A heat sink 47, typically in the form of an aluminum backing plate, is fixed to a left side 49 of ceramic substrate 45. Heat sink 47 rapidly dissipates heat generated by the thermal resistors 43 during printing. In the embodiment shown in FIG. 2, thermal resistors 43 are arranged in a linear array extending across platen 46 (shown in phantom.) Such a linear arrangement of thermal resistors 43 is commonly known as a heat line or print line. However, other non-linear arrangements of thermal resistors 43 can be used. Further, it will be appreciated that there are a wide variety of other arrangements of thermal resistors 43 and thermal printheads 22 that can be used in conjunction with the present invention.

Thermal resistors 43 are adapted to generate heat in proportion to an amount of electrical energy that passes through thermal resistors 43. During printing, controller 20 transmits signals to a circuit board 51 to which thermal resistors 43 are connected causing different amounts of electrical energy to be applied to thermal resistors 43 so as to selectively heat donor web 30 in a manner that is intended to cause donor material from donor patches 34, 36, 38, and 40 to be applied to receiver web 26 in a desirable manner.

Figure 3:
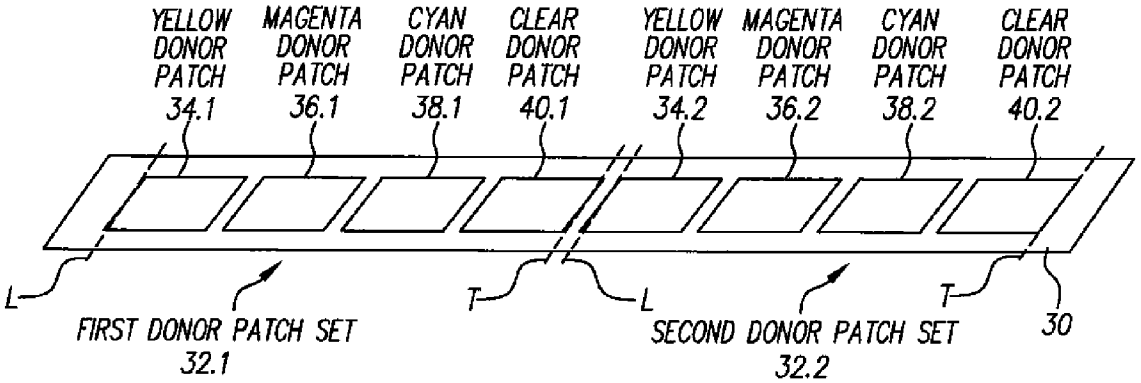
FIG. 3 shows a donor web.

As is shown in FIG. 3, donor web 30 comprises a first donor patch set 32.1 having a yellow donor patch 34.1, a magenta donor patch 36.1, a cyan donor patch 38.1 and a clear donor patch 40.1 and a second donor patch set 32.2 having a yellow donor patch 34.2, a magenta donor patch 36.2, a cyan donor patch 38.2 and a clear donor patch 40.2. Each donor patch set 32 has a leading edge (L) and a trailing edge (T). In order to provide a full color image with a clear protective coating, the four patches of each set 32.1 and 32.2, etc. are printed, in registration with each other, onto a common image receiving area 52 of receiver medium 26 shown in FIG. 4. Circuit board 51 provides variable electrical signals to thermal resistors 43 in accordance with the signal from controller 20.

A first color is printed in the conventional direction, from right to left as seen by the viewer in FIGS. 1 and 3. During printing, controller 20 raises printhead 22 and actuates donor web supply roller 50 and donor web take-up roller 48 to advance a leading edge L of a first donor patch set 32.1 to printhead 22. In the embodiment illustrated in FIGS. 1-3, leading edge L for first donor patch set 32.1 is defined by a leading edge of a yellow donor patch 34.1. As will be discussed in greater detail below, the position of this leading edge L can be determined by using a position sensor to detect a marking, indicia on donor web 30 that has a known position relative to the leading edge of yellow donor patch 34.1 or by directly detecting leading edge of yellow donor patch 34.1 as will be discussed in greater detail below.

Controller 20 also actuates receiver medium take up roller 42 and receiver medium supply roller 44 so that image receiving area 52 of receiver medium 26 is positioned with respect to the printhead 22. In the embodiment illustrated, image-receiving area 52 is defined by a leading edge LER and a trailing edge TER on receiver medium 26. Donor web 30 and receiver medium 26 are positioned so that leading edge LED of yellow donor patch 34.1 is registered at printhead 22 with leading edge LER of image receiving area 52. Controller 20 then causes a motor or other conventional structure to (not shown) lower printhead 22 so that a lower surface of donor web 30 engages receiver medium 26 which is supported by platen roller 46. This creates a pressure holding donor web 30 against receiver medium 26.

Controller 20 then actuates receiver medium take-up roller 42, receiver medium supply roller 44, donor web take-up roller 48 and donor web supply roller 50 to move receiver medium 26 and donor web 30 together past the printhead 22. Concurrently, controller 20 selectively operates heater elements in printhead 22 to transfer donor material yellow donor patch 34.1 to receiver medium 26.

Figure 4:
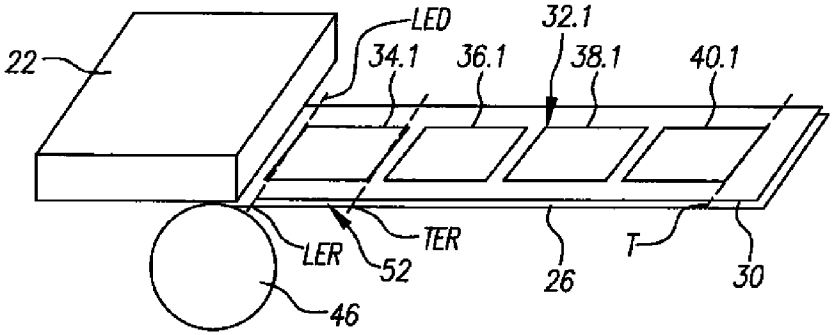
FIG. 4 shows a printhead, platen, donor web, and receiver web during printing.
Figure 5:
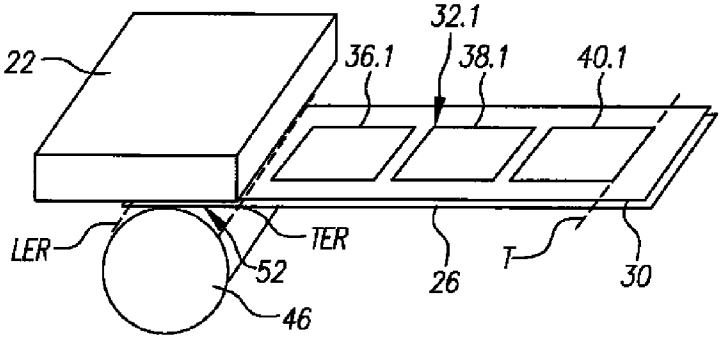
FIG. 5 shows a printhead, platen, donor web, and receiver web during printing.

As donor web 30 and receiver medium 26 leave the printhead 22, a stripping plate 54 separates donor web 30 from receiver medium 26. Donor web 30 continues over idler roller 56 toward the donor web take-up roller 48. As shown in FIG. 4, the trailing edge TER of image receiving area 52 of receiver medium 26 remains on platen roller 46. Controller 20 then adjusts the position of donor web 30 and receiver medium 26 using a predefined pattern of donor web movement so that a leading edge of each of the remaining donor patches 36.1, 38.1 and 40.1 in the first donor patch set 32.1 are brought into alignment with leading edge LER of image receiving area 52 and the printing process is repeated to transfer further material as desired to complete image format.

Controller 20 operates the printer 18 based upon input signals from a user input system 62, an output system 64, a memory 68, a communication system 74 and sensor system 80. User input system 62 can comprise any form of transducer or other device capable of receiving an input from a user and converting this input into a form that can be used by controller 20. For example, user input system 62 can comprise a touch screen input, a touch pad input, a 4-way switch, a 6-way switch, an 8-way switch, a stylus system, a trackball system, a joystick system, a voice recognition system, a gesture recognition system or other such systems. An output system 64, such as a display, is optionally provided and can be used by controller 20 to provide human perceptible signals for feedback, informational or other purposes.

Data including, but not limited to, control programs, digital images and metadata can also be stored in memory 68. Memory 68 can take many forms and can include without limitation conventional memory devices including solid state, magnetic, optical or other data storage devices. In the embodiment of FIG. 1, memory 68 is shown having a removable memory interface 71 for communicating with removable memory (not shown) such as a magnetic, optical or magnetic disks. In the embodiment of FIG. 1, memory 68 is also shown having a hard drive 72 that is fixed with printer 18 and a remote memory 76 that is external to controller 20 such as a personal computer, computer network or other imaging system.

In the embodiment shown in FIG. 1, controller 20 has a communication system 74 for communicating external devices such as remote memory 76. Communication system 74 can be for example, an optical, radio frequency circuit or other transducer that converts electronic signals representing an image and other data into a fort that can be conveyed to a separate device by way of an optical signal, radio frequency signal or other form of signal. Communication system 74 can also be used to receive a digital image and other information from a host computer or network (not shown). Controller 20 can also receive information and instructions from signals received by communication system 74.

Sensor system 80 includes circuits and systems that are adapted to detect conditions within printer 18 and, optionally, in the environment surrounding printer 18 and to convert this information into a form that can be used by controller 20 in governing printing operations. Sensor system 80 can take a wide variety of forms depending on the type of media therein and the operating environment in which printer 18 is to be used.

In the embodiment of FIG. 1, sensor system 80 includes an optional donor position sensor 82 that is adapted to detect the position of donor web 30 and a receiver medium position sensor 84. Controller 20 cooperates with donor position sensor 82 to monitor donor web 30 during movement thereof so that controller 20 can detect one or more conditions on donor web 30 that indicate a leading edge of a donor patch set. In this regard, a donor web 30 can be provided that has markings or other optically, magnetically or electronically sensible indicia between each donor patch set 32 and/or between donor patches 34, 36, 38 and 40. Where such markings or indicia are provided, position sensor 82 is provided to sense these markings or indicia and to provide signals to controller 20. Controller 20 can use these markings and indicia to determine when donor web 30 is positioned with the leading edge of the donor patch set at printhead 22. In a similar way, controller 20 can use signals from receiver medium position sensor 84 to monitor the position of the receiver medium 26 to align receiver medium 26 during printing. Receiver medium position sensor 84 can be adapted to sense markings or other optically, magnetically or electronically sensible indicia between each image receiving area of receiver medium 26.

During a full image printing operation, controller 20 causes donor web 30 to be advanced in a predetermined pattern of distances so as to cause a leading edge of each of the first donor patches 34.1, 36.1, 38.1 and 40.1 to be properly positioned relative to the image receiving area 52 at the start each printing process. Controller 20 can optionally be adapted to achieve such positioning by precise control of the movement of donor web 30 using a stepper type motor for motorizing donor web take up roller 48 or donor web supply roller 50 or by using a movement sensor 86 that can detect movement of donor web 30. In one example an arrangement using a movement sensor 84, a follower wheel 88 is provided that engages donor web 30 and moves therewith. Follower wheel 88 can have surface features that are optically, magnetically or electronically sensed by movement sensor 86. One example of this is a follower wheel 88 that has markings thereon indicative of an extent of movement of donor web 30 and a movement sensor 86 that has a light sensor that can sense light reflected by the markings. In other optional embodiments, perforations, cutouts or other routine and detectable indicia can be incorporated onto donor web 30 in a manner that enables movement sensor 84 to provide an indication of the extent of movement of the donor web 30.

Alternatively, donor position sensor 82 can also optionally be adapted to sense the color of donor patches on donor web 30 and can provide color signals to controller 20. In this alternative, controller 20 is programmed or otherwise adapted to detect a color that is known to be found in the first donor patch, e.g. yellow donor patch 34.1 in a donor patch set such as first donor patch set 32.1. When the first color is detected, controller 20 can determine that donor web 30 is positioned proximate to the start of a donor patch set.

In the embodiment illustrated in FIGS. 1 and 2, sensor system 80 has a first thermal sensor 90 which can comprise, for example a thermistor, thermocouple, bi-metal switch or other electrical sensor, electromechanical sensor, electro-optical sensor or other sensor that is adapted to sense an amount of thermal energy at printhead 22. First thermal sensor 90 generates a primary thermal feedback signal representative of the temperature of printhead 22. In the embodiment illustrated, first thermal sensor is incorporated in ceramic substrate 45. However, this is not necessary, and first thermal sensor 90 can be located, for example in heat sink 47, or on circuit board 51. Typically, first thermal sensor 90 will be located in contact with a portion of printhead or in a structure that is physically connected to printhead 22. Where first thermal sensor 90 comprises an opto-electrical sensor such as an infrared sensor, first thermal sensor can be located apart from printhead, such as on an opposing surface.

As is also shown in the embodiment of FIGS. 1 and 2, sensor system 80 can include an optional second thermal sensor 92 which can comprise, for example a thermistor, thermocouple, bi-metal switch or other electrical sensor, electromechanical sensor, electro-optical sensor or other sensor that is adapted to sense an amount of thermal energy. Second thermal sensor 92 is adapted to sense thermal energy indicative of the ambient temperature proximate to said printhead. The second thermal sensor is adapted to generate a second thermal feedback signal representative of the level the ambient temperature proximate to the printhead. In the embodiment illustrated second thermal sensor 90 detects an ambient temperature in a cooling zone 96 proximate to printhead 22 into which thermal energy from the printhead is radiated. It will be appreciated that this ambient temperature measurement will be inversely proportional to the time rate of thermal transfer of heat from printhead 22. It will also be appreciated that the location of thermal sensor 92 and cooling zone 96 in FIG. 1 are exemplary only, and that thermal sensor 92 can be located to sense the temperature of any cooling zone into which heat is radiated by printhead 22 during cooling of the printhead 22.

Figure 6:
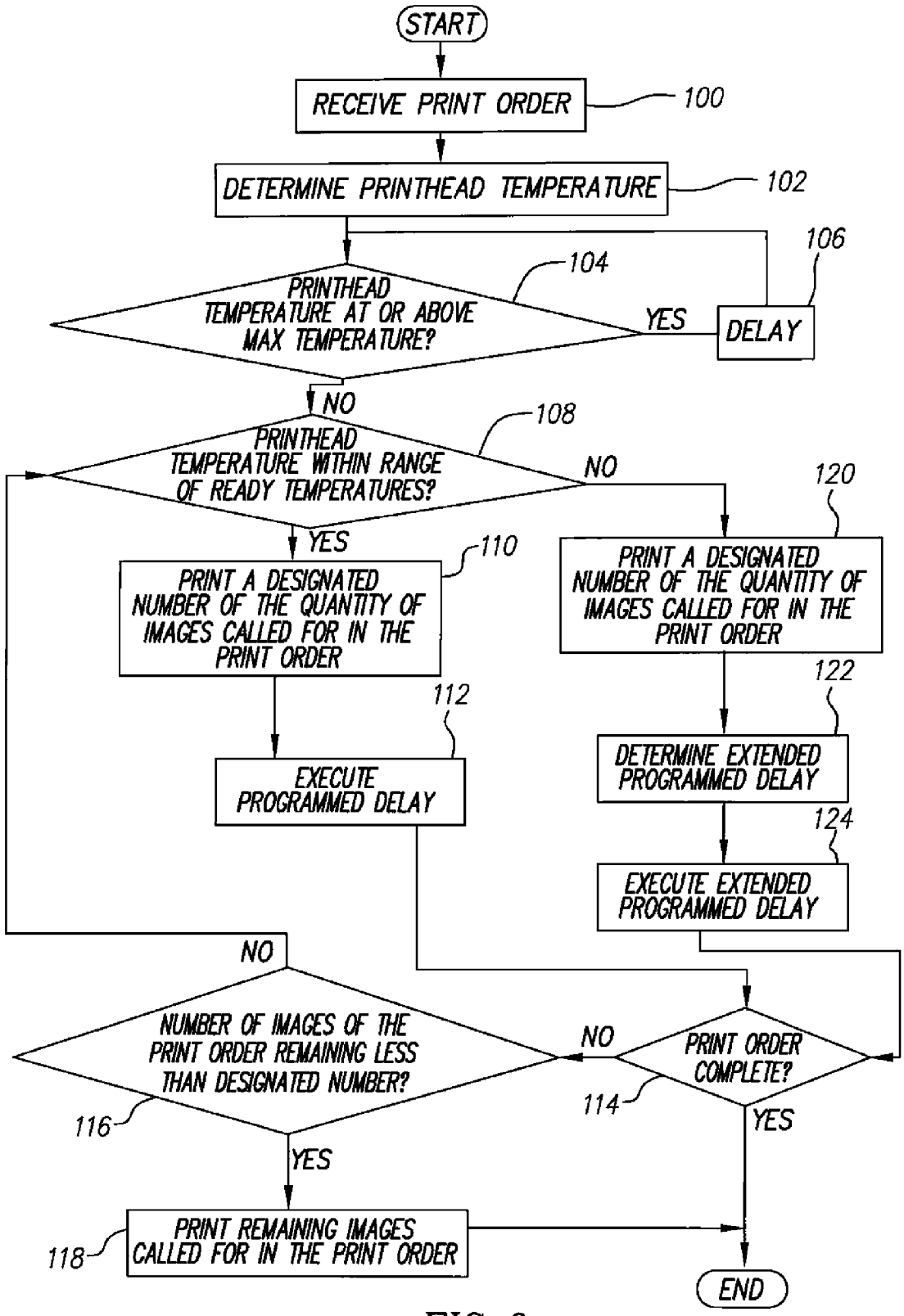
FIG. 6 shows one embodiment of a method for operating a printer in accordance with the invention.

FIG. 6 shows a flow diagram illustrating one embodiment of a method for operating a printer 18 in accordance with the invention. As is shown in the embodiment of FIG. 6, an initial print order is received by the printer (step 100). Controller 20 can receive the print order in a variety of ways including but not limited to receiving entries made by way of user input system 62, signals received at a communication system 74 or in response to a data provided by way of memory 68 including but not limited to data provided by way of a removable memory (not shown).

The print order contains instructions sufficient for controller 20 to initiate printing operations. Accordingly, each print order generally provides sufficient information from which controller 20 can determine what images are to be printed and the quantity of images to be printed. Typically, the print order will provide image data for the images to be printed, however, the print order can simply designate a location at which the printer can obtain the image data.

Controller 20 then determines a temperature of printhead 22 (step 102) based upon the first feedback signal from first temperature sensor 90. In the embodiment of FIG. 1, controller uses the temperature of printhead 22 to determine whether a thermal printhead 22 is at a maximum printhead temperature.

Controller 20 will have programming that indicates a maximum printhead temperature above which printhead 22 is not to be used for printing (step 104). When the temperature of printhead 22 is at or above the maximum printing (step 104) will be delayed (step 106) until the temperature of printhead 22 is reduced to a temperature below the maximum printhead temperature (step 104).

Where printhead 22 is within a range of a ready temperatures, controller 20 can cause the printing of the images called for in the print order (step 108). Under these circumstances, controller 20 causes a sequence of the images from the print order to be printed in a sequential manner (step 110). After a designated number of images have been printed in sequence, controller 20 interposes a programmed delay before printing additional images (step 112). The programmed delay permits periodic cooling of printhead 22 so that printhead 22 can be used to print more images without reaching the maximum temperature for printhead 22. As will be discussed below, the duration of the programmed delay can vary significantly. However, when printhead temperatures are within the range of ready temperatures the length of the programmed delay is minimized to provide high print speed. The designated number of images printed between programmed delays can be predetermined, can be user selected, or can be automatically determined by controller 20. During such printing the temperature of printhead 22 is monitored by controller 22 to determine whether the temperature of printhead 22 has been elevated so that it is within a range of elevated temperatures (step 108).

Likewise, when it is determined that printhead 22 is within a range of elevated temperatures (step 108), controller 20 causes printhead 22 to execute at least one programmed delay between at least two of the successive prints of the print order. However, when the temperature of the printhead 22 is within the range of elevated temperatures, controller 20 determines a length of an extended programmed delay (step 122) and executes an extended programmed delay (step 124). Controller 20 determines the length of the programmed delay based upon the temperature of printhead 22 and a time rate of cooling of printhead 22.

The time rate of cooling of printhead 22 is a function of the thermal transfer characteristics of printhead 22, including but not limited to, thermal resistors 43 and structures positioning and contacting thermal resistors 43 such as, where applicable, ceramic substrate 45 and heat sink 47. It will be appreciated that the time rate of cooling of printhead 22 will also be inversely proportional to an ambient temperature into which heat from printhead 22 is radiated. This ambient temperature can vary significantly depending upon the operational environment of printer 18, thus it is necessary to provide a controller 20 with an ability to determine the time rate of cooling of printhead 22 so that unnecessary cooling time is not interposed during the printing of the images of a print order.

In the embodiment illustrated in FIG. 1, second thermal sensor 92 is used for determining an ambient temperature and provides a second thermal feedback signal from which controller 20 can determine a time rate of cooling (step 122).

It will be appreciated that at higher ambient temperatures it will take longer for heat in printhead 22 to dissipate. To prevent printhead 22 from reaching the maximum printhead temperature during periods of elevated temperature printing, it is useful to interpose longer programmed printing delays between successive sequences of printing a designated number of images.

Table I illustrates one example of a look up table that illustrates the way in which ambient temperature and the length of a programmed delay are related. As can be seen in Table I, when the temperature of printhead 22 is within an elevated temperature range of 110° C.-125° C. As shown in Table I, controller 20 uses a minimum programmed delay while the ambient temperature is between 78° F.-85° F. However, as ambient temperature increases, the time rate of cooling decreases and the length of each programmed delay is extended.

| Ambient Temperature (F.) | Programmed Delay |
|---|---|
| 78° | Minimum |
| 79° | Minimum |
| 80° | Minimum |
| 81° | Minimum |
| 82° | Minimum |
| 83° | Minimum |
| 84° | Minimum |
| 85° | Minimum |
| 86° | 1.8 × minimum |
| 87° | 2.8 × minimum |
| 88° | 3.7 × minimum |
| 89° | 4.5 × minimum |
| 90° | 5.4 × minimum |
| 91° | 6.3 × minimum |
| 92° | 7.14 × minimum |
| 93° | 8.1 × minimum |
| 94° | 9.0 × minimum |
| 95° | 9.85 × minimum |
| 96° | 10.71 × minimum |
| 97° | 10.71 × minimum |
| 98° | 10.71 × minimum |
| 99° | 10.71 × minimum |
| 100° | 10.71 × minimum |
| 101° | 10.71 × minimum |
| 102° | 10.71 × minimum |
| 103° | 10.71 × minimum |
| 104° | 10.71 × minimum |

For example, where controller 20 receives a print order for the printing of 50 images, and at an ambient temperature of 86° F. (35° C.) and below, the printer controller 20 using the look up table, Table I, can determine a printing pattern that includes a normal 8.5 second print time per image with at least a minimum a programmed delay (e.g. 2.0 seconds) occurring after the printing of a designated number of images, such as five images. It can be anticipated that the temperature at printhead 22 will rise while printing such a volume of images in a sequential manner. However, the pattern of programmed delays that occur does not require any single cool down period to exceed a maximum delay time of 21.5 seconds. Such a pattern provides for generally continuous printing performance of at least fifty images resulting in a total 50 print cycle time of 457 seconds (7 minutes, 37 seconds) or average print time for 50 sequential prints of 9.14 seconds.

Similarly, where the print order comprises an order for the printing of a quantity of 50 images in an environment wherein the ambient temperature is at 96° F. (35° C.), printer controller 20 can refer to Table I and determine that it is possible to maintain continuous printing performance of at least fifty (50) images, allowing for periodic cool downs that result in a total 50 print cycle time of 618 seconds (10 minutes, 18 seconds) or an average print time for 50 sequential prints of 12.36 seconds. This 50 sequential print cycle time allows for a normal 8.5 second print time and with a 21.5 second programmed delay after every fifth print at this elevated temperature. Here too, no single cool down period is to exceed 21.5 seconds.

It will be appreciated that there are many different ways in which look up tables can be used by controller 20. For example, in a particular printer, it may be useful to provide more than one look up table with one look up table being applicable when a printhead 22 is within a first range of temperatures and another look up table being applicable when a printhead 22 is within a second range of temperatures. In another embodiment, a three-dimensional look up table can also be provided to relate printhead temperatures and ambient temperatures with a desired length of a programmed delay.

Controller 20 can determine a printing/programmed delay pattern in advance or portions thereof can be determined during the printing operation. For example, in another embodiment of the invention, the time rate of cooling of printhead 22 can be determined by controller 20 without requiring a second thermal sensor 92. In this embodiment, controller 20 is adapted to provide a programmed delay of the minimum amount of time during periods where printhead 22 is at an elevated temperature and, during the minimum amount of time of the programmed delay, controller 20 determines the time rate of change of the temperature at first thermal sensor 90 by monitoring the first feedback signal to determine the extent of the temperature change that occurs during the minimum programmed delay. Controller 20 then determines a time rate of cooling of printhead 22 based upon the extent of the temperature change at printhead 22 during the minimum programmed delay and from this determines an extent of any desired extended delay.

In another example, controller 20 can be adapted to monitor the temperature of printhead 22 and/or to determine a time rate of cooling of printhead 22 during a minimum portion of a programmed pause and to determine the length of that programmed pause in a manner that allows a next sequence of a designated number of images to be printed without heating printhead 22 to a maximum temperature.

Optionally, instead of the use of a look up table, the length of a programmed delay can be determined based upon a mathematical calculation made by controller 20 based upon the temperature of the printhead and the time rate of cooling or the automatic execution of another functional relationship can be used.

It will be appreciated that controller 20 can be adapted to execute programmed delays in a pattern that is other than one programmed delay after a statically designated number of images has been printed, such as after every fifth print as has been described in the example above. Specifically, controller 20 can designate a programmed delay between each image, after two images, etc. Such a determination can likewise be made based upon the number of images to be printed, the initial temperature of printhead 22 and, optionally, the time rate of cooling of printhead 22. For example, controller 20 can be adapted to execute a programmed delay after a designated number of printed images for large batches of images and to execute a programmed delay after a different designated number of images for smaller batches of images.

Conversely, controller 20 can be optionally adapted to omit execution of an extended programmed delay or to omit execution of a programmed delay entirely where controller 20 determines that the remainder of the print order requires a quantity of images that is less than the designated number of images (step 116), such as in the example above where a print order requests only six or seven images to be printed in the print order. In this way, short batches of images that only modestly extend past a designated number of images can be printed (step 118) without unnecessary programmed delays.

The invention has been described in detail with particular reference to certain preferred embodiments thereof, but it will be understood that variations and modifications can be effected within the spirit and scope of the invention.

The invention claimed is:

1. A thermal printer comprising:

a donor transport system having a motorized system for advancing a donor web relative to a printhead, said donor web having patches of donor material including at least one colored donor material;

a receiver transport system having a motorized system for advancing a receiver web relative to the printhead; said printhead being able to actuate heat and transfer donor material from the donor web to the receiver web;

a first thermal sensor adapted to sense thermal energy indicative of the temperature of the printhead and to generate a primary thermal feedback signal representative of the temperature of the printhead;

a controller for controlling the operation of the donor transport system, the receiver transport system, and the printhead so as to enable imagewise transfer of donor material onto the receiver web to form a sequence of at least two images said controller being operable to interpose at least one programmed delay between the printing of at least two of the images in the sequence;

wherein said controller determines the length of each programmed delay by using the temperature of the thermal printhead and a time rate of cooling of the printhead in a manner that is adapted to provide a sufficient cooling time to prevent the printhead from reaching a maximum printhead temperature during printing of the sequence of images.

2. The printer of claim 1, wherein said thermal printhead comprises an array of thermal resistors mounted to a surface and wherein said first thermal sensor is mounted to the surface.

3. The printer of claim 1, wherein said controller further determines a length of each programmed delay in a manner that is to minimize the amount of time required to print all of the quantity of images requested in a print order.

4. The printer of claim 2, wherein said controller is adapted to determine when to execute the programmed delay based upon the first feedback signal and the determined time rate of cooling of the printhead.

5. The printer of claim 1, further comprising a second thermal sensor adapted to sense thermal energy indicative of the ambient temperature proximate to said printhead said second thermal sensor further being adapted to generate a secondary thermal feedback signal representative of the level the ambient temperature of the printhead and wherein said controller determines the time rate of cooling based upon the ambient temperature indicated in the second thermal feedback signal.

6. The printer of claim 5, wherein said second thermal sensor detects an ambient temperature in an area proximate to the printhead and into which thermal energy from the printhead is radiated.

7. The printer of claim 1, wherein said controller is adapted to execute the programmed delay for a minimum period of time during which the controller monitors the temperature of the printhead, to determine the time rate of cooling based upon changes in the temperature of the printhead during the minimum period of time and to determine whether to extend the programmed delay beyond the minimum period based upon the determined time rate of cooling and the temperature of the printhead.

8. The printer of claim 1, wherein each programmed delay has a minimum length of time and wherein said programmed delay can extend for a period of up to 20 times the minimum length of time.

9. The printer of claim 1, wherein said controller is adapted to determine, from the print order, a number of images to be printed and to determine a pattern of programmed delays that is intended to minimize the overall amount of cooling time during the print job, said pattern being based upon the temperature of the printhead and the ambient temperature at the start of the printing job.

10. The printer of claim 1, wherein the length of a programmed delay is proportional to the printhead temperature and inversely proportional to the determined time rate of cooling of the printhead.

11. A method for operating a printer that applies donor material from donor patches on a donor web to a receiver medium using a thermal printhead that generates heat; the method comprising the steps of:

receiving a print order requesting the printing of a quantity of images;

determining a temperature of the printhead;

printing a designated number of the quantity of the images in a sequence;

determining a length of time of a programmed delay;

delaying the printing for the determined length of time of the programmed delay; and printing remaining images from the quantity of images;

wherein the length of each programmed delay is determined by using the temperature of the printhead and a time rate of cooling of the printhead and is determined in a manner that provides a sufficient cooling time to prevent the printhead from reaching a maximum printhead temperature during printing of the sequence of images.

12. The method of claim 11, wherein the step of printing remaining images from the quantity of images comprises determining that the quantity of images remaining is greater than the designated number of images, printing an additional sequence of the designated number of images from the print order, determining a length of time for an additional programmed delay, delaying for the determined length of time of the additional programmed delay and printing remaining images from the quantity of images.

13. The method of claim 11, further comprising the step of determining a time rate of cooling of the printhead by sensing a temperature in an area into which heat radiated by the printhead flows during cooling of the printhead and determining the time rate of cooling based upon the ambient temperature.

14. The method of claim 11, further comprising the step of determining a time rate of cooling of the printhead by allowing the printhead to cool for a period of time, sensing the temperature changes during that period, and determining a time rate of cooling based upon the change in temperature at the printhead during that time.

15. The method of claim 11, further wherein each programmed delay extends for a minimum period of time and wherein said programmed delay can extend for a length of time that is greater than the minimum period with the length of the extended programmed delay being proportional to a temperature of the printhead and inversely proportional to a determined time rate of cooling of the printhead.

16. The method of claim 15, wherein the step of determining a length of a programmed delay comprises delaying printing for a minimum programmed delay time and determining during the minimum programmed delay time, whether the length of the delay is to be greater than the minimum programmed delay time.

17. A method for operating a printer that applies donor material from donor patches on a donor web to a receiver medium using a thermal printhead that generates heat; the method comprising the steps of:

receiving a print order requesting the printing of a quantity of images;

determining the temperature of the printhead;

organizing the quantity of images requested in the print order into sequences of a determined number of images; and printing the sequences of images with a programmed delay between each sequence;

wherein the length of each programmed delay is determined based upon the temperature of the thermal printhead and a time rate of cooling of the printhead and is calibrated in a manner that provides a sufficient cooling time to prevent the printhead from reaching a maximum printhead temperature during the printing of a subsequent one of the sequences.

18. The method of claim 17, wherein the determined programmed delay is further calibrated to prevent the printhead from reaching a maximum printhead temperature during the printing of the images of the print order while also minimizing the amount of time required for printing.

19. The method of claim 17, wherein each programmed delay is no less than a minimum amount of time and wherein any programmed delay can extend to a period of about up to 20 times the minimum amount of time.

20. The method of claim 17, wherein the length of a programmed delay is proportional a printhead temperature and inversely proportional to the determined time rate of cooling of the printhead.

* * * * *